United States Patent [19]

Karcher

[11] 4,167,954

[45] Sep. 18, 1979

[54] WEFT THREAD CONVEYING APPARATUS FOR SHUTTLELESS WEAVING MACHINES

[75] Inventor: Charles Karcher, Küsnacht, Switzerland

[73] Assignee: Ruti Machinery Works Ltd., Ruti, Switzerland

[21] Appl. No.: 818,843

[22] Filed: Jul. 25, 1977

[30] Foreign Application Priority Data

Jul. 27, 1976 [CH] Switzerland ..... 9558/76
Jun. 1, 1977 [CH] Switzerland ..... 6742/77

[51] Int. Cl.[2] ..... D03D 47/34

[52] U.S. Cl. ..... 139/452; 226/174; 226/177

[58] Field of Search ..... 139/452, 435; 226/168, 226/174

[56] References Cited

U.S. PATENT DOCUMENTS 3,915,199 10/1975 Kida ..... 139/452
3,926,224 12/1975 Vermeulen et al. ..... 139/452

*Primary Examiner*—Henry Jaudon
*Attorney, Agent, or Firm*—Donald D. Denton

[57] ABSTRACT

A weft thread conveying apparatus having at least one pair of weft thread conveying rollers with each roller having two conical shaped peripheral portions inclined to each other and extending upward from the roller edge towards the middle thereof and means for tilting one of the rollers to selectively engage a weft thread positioned between corresponding peripheral portions of the rollers.

10 Claims, 7 Drawing Figures

WEFT THREAD CONVEYING APPARATUS FOR SHUTTLELESS WEAVING MACHINES

BACKGROUND OF THE INVENTION

The invention relates to a weft thread conveying apparatus for shuttleless weaving machines, more particularly for nozzle-type weaving machines having two insertion nozzles, with a pair of conveying rollers which are capable of being driven continuously.

In a known weft thread conveying apparatus of this kind, there are provided two pairs of conveying rollers which can be driven separately from one another, the first conveying roller of each pair being situated in a stationary fashion and each second roller being capable of being lifted away from the first roller associated with it to an extent which prevents the conveying of the weft thread. The two conveying rollers of each pair are in each case connected with toothed wheels which are kept constantly in engagement with one another.

When each second conveying roller is lifted away from the first conveying roller associated with it, the associated toothed wheels are also moved away from one another but only to such an extent that they remain in engagement in one another.

This movement of the toothed wheels associated with the conveying rollers relatively to one another has the effect that in the event of the larger inter-axes spacing of the toothed wheels corresponding to the lifted-away position of the second conveying roller, the teeth of the said wheels run with a relatively considerable amount of play. This results on the one hand in increasing the amount of noise produced to a considerable extent and on the other hand results in an increased amount of wear on the toothed wheels.

The closest prior art known to applicant in connection with this application is U.S. Pat. No. 3,885,599.

SUMMARY OF THE INVENTION

The present invention obviates the aforesaid disadvantages in that the pair of conveying rollers is formed by two rollers the periphery of which consists in each case of two conical peripheral portions situated at an inclination to one another and each intended to convey one weft thread, these peripheral portions extending upwards from the edge of the roller towards the middle of the roller, and one of the two conveying rollers is mounted to be capable of tilting movement for the selective pressure application of one of its peripheral portions against the corresponding peripheral portion of the other conveying roller.

Thus in contrast to the known apparatus, the weft thread conveying apparatus according to the present invention comprises only a single pair of conveying rollers, but owing to the conical peripheral portions of these rollers they can convey two weft threads. Since the conveying rollers do not have any driving toothed wheels which are moved away from one another and towards one another, the problems involved with this movement of the toothed wheels are also eliminated.

The invention also concerns a weft thread conveying apparatus for nozzle-type weaving machines which can be used for the conveying of more than two weft threads, for example four different weft threads.

This weft thread conveying apparatus is characterized in that a plurality of pairs of conveying rollers are provided, and there are associated with each pair of conveying rollers two insertion nozzles, and that each of the rollers comprises a third peripheral portion situated between the two conical peripheral portions and in the form of a straight circular cylinder; and when the two rollers of a pair of conveying rollers abut on one another at their third peripheral portions, the two associated weft threads are released and are not conveyed.

BRIEF DESCRIPTION OF THE DRAWINGS

These and other objects and advantages of the invention will become apparent from the detailed explanation with reference to constructional examples and the illustrations shown in the drawings, in which.

DESCRIPTION OF PREFERRED EMBODIMENTS

Figure 1:
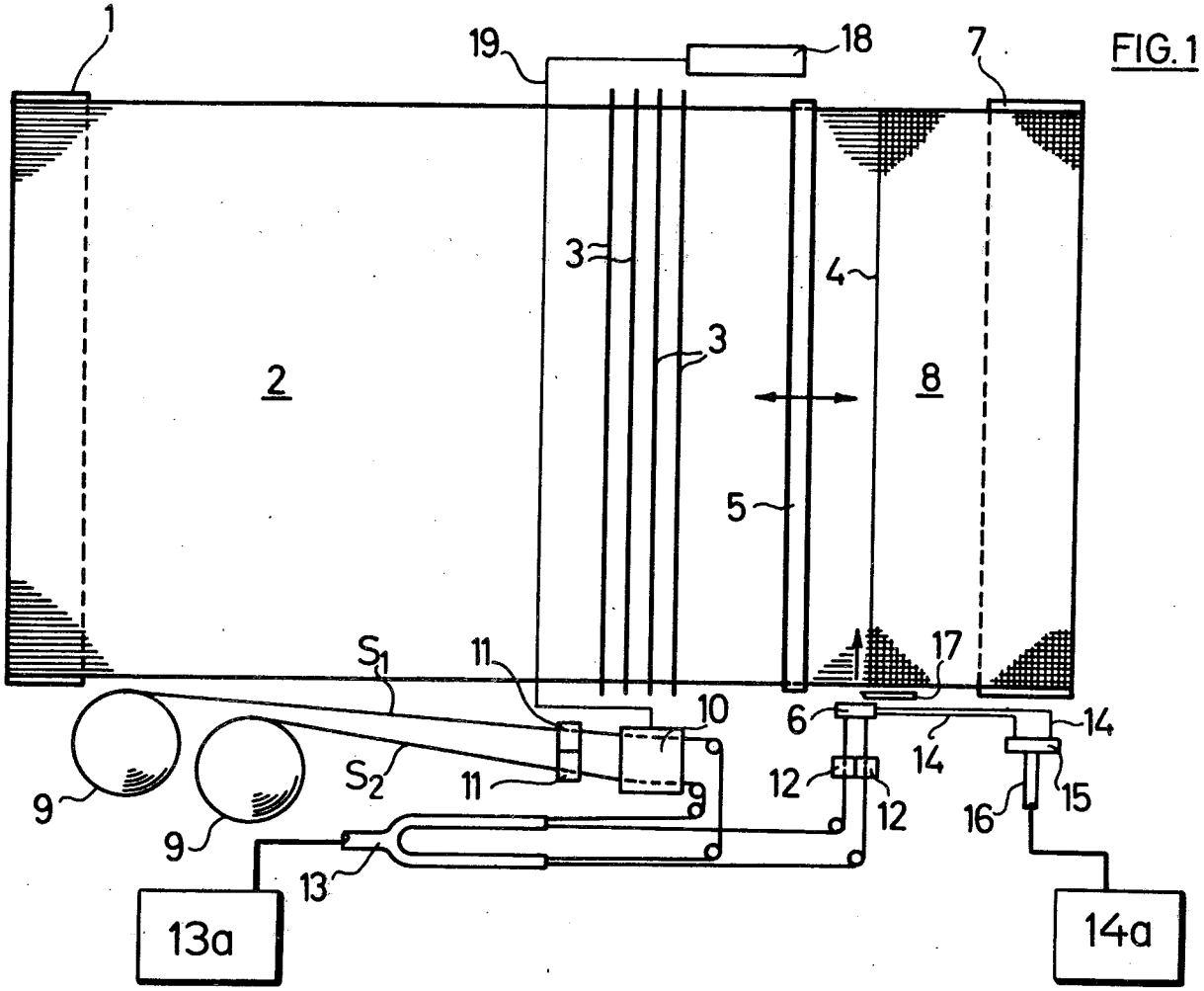
FIG. 1 is a diagrammatic plan view showing a nozzle-type weaving machine utilizing the invention.

The nozzle-type weaving machine shown in FIG. 1 is of the type as described in U.S. Pat. No. 3,885,599 and shows substantially a warp beam 1 from which warp threads 2 run over shafts 3 to a beaten-up edge 4 of fabric 8 formed during the weaving operation, a reed 5, a picking or insertion device 6, and a beam 7 on which the fabric is wound.

At one side of the weaving machine frame there is arranged a holder (not shown) for two weft thread bobbins 9, and weft threads $S_1$, $S_2$, respectively, which are drawn from each of these bobbins by a conveying apparatus 10. Between the weft thread bobbins 9 and the conveying apparatus 10 and also immediately upstream of the insertion device 6 there is provided for each weft thread $S_1$, $S_2$ a controlled thread brake 11 and 12 respectively. Each of the thread brakes 11 and 12 respectively comprises a pair of clamping discs between which a weft thread $S_1$ and $S_2$ passes. In each pair of discs, one disc is capable of being lifted away from the other disc so that the weft thread in the lifted-away position can travel freely through between the discs and is clamped fast in the other position of the discs. The weft threads $S_1$ and $S_2$ are guided from the conveying apparatus 10 by way of guide rollers to a storage device 13 and run from this device over further guide rollers and through the thread brakes 12 to the insertion device 6.

The storage device 13 has a shape resembling a tuning fork with a U-shaped storage portion and a suction tube extending away from the bottom of the U-shaped portion. The tube is connected to a suction source 13*a* by means of which air can be drawn continuously through the two legs of the U-shaped storage portion. This air suction carries along a weft thread $S_1$, $S_2$ conveyed by the conveying device 10, and draws it into the particular leg of the storage portion.

The insertion device 6 is formed of a stationary, multiple nozzle arrangement, for example a double nozzle.

A nozzle arrangement of this kind, formed essentially of two nozzles in the form of small curved tubes, is described in Swiss Pat. No. 571,597 and in U.S. Pat. No. 4,081,000. In a nozzle arrangement of this kind, owing to the compact arrangement, the positioning operations which are usually required at each weft thread change for the individual nozzles are dispensed with.

Each nozzle of the insertion device 6, through each of which a weft thread $S_1$ or $S_2$ runs, is connected by way of a fluid conduit 14 to a change-over valve 15. The change-over valve 15 is connected by way of a conduit 16 to a pump means 14*a*. The pump means conveys intermittently a fluid which is fed by way of the change-over valve 15 of the nozzle of the insertion device 6 which is required at the instant in question, whereupon the particular weft thread $S_1$ or $S_2$ is introduced into the shed in the direction indicated by an arrow. A weft thread parting device 17 is arranged in the space between the insertion device 6 and the adjacent fabric edge.

At the side of the machine frame situated opposite from the insertion device 6 there is situated a program setter means 18 which, by means of a given program, controls the operations of the thread brakes 11 and 12, the conveying apparatus 10, and the change-over valve 15. The program setter means 18 is connected with all these elements, but for the sake of leaving the drawings easier to read, only the connection 19 between the program setter means 18 and the conveying apparatus 10 is shown. The control of the conveying of the fluid in the conduit 16 is effected by coupling the pump means 14*a*, connected to the conduit 16, with the drive of the weaving machine.

Figure 3:
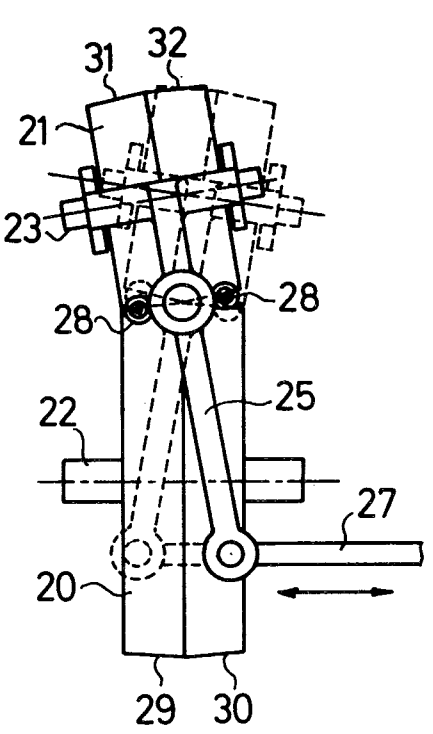
FIG. 3 is a view in the direction of the arrow III of FIG. 2.
Figure 2:
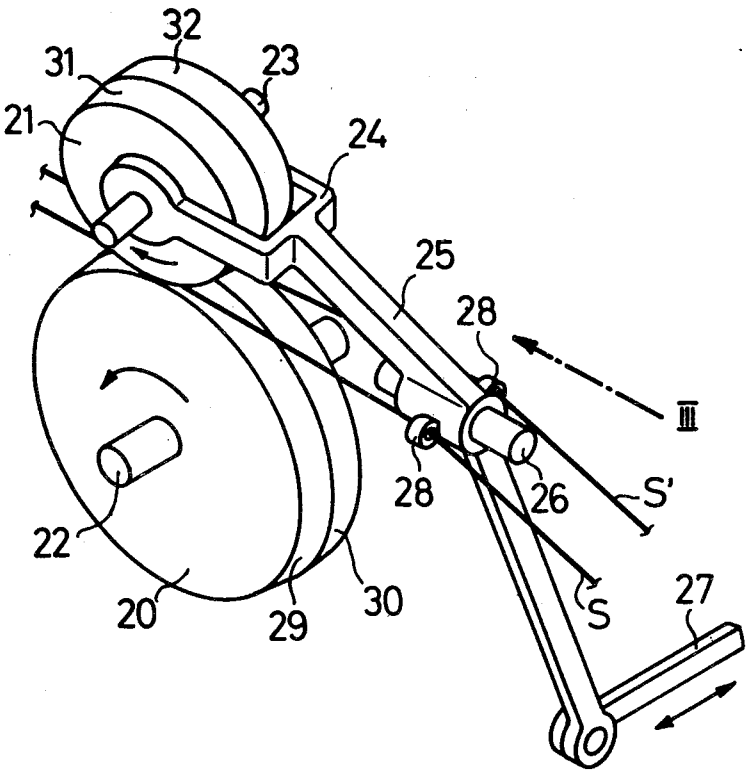
FIG. 2 is a view in perspective showing a detail of the single pair of conveying rollers.

In FIGS. 2 and 3 the conveying apparatus 10 shown in FIG. 1 illustrates substantially a pair of conveying rollers comprising a measuring roller 20 and a pressure roller 21. The measuring roller 20 is mounted on a driving shaft 22 and during operation rotates constantly in the direction indicated by an arrow. The pressure roller 21 is mounted to be capable of free rotational movement by means of a shaft 23 in the fork-shaped end 24 of a two-arm lever 25. The fork 25 is mounted approximately at its central portion on a stationary pivot pin 26. The other end of the lever 25 is connected pivotably to an operating lever 27 capable of being controlled by program setter means 18 by way of a connection 19. At the central portion of the lever 25 mounted on the pivot pin 26 for movement about the said pin there are situated two guide eyelets 28 for the weft threads $S_1$, $S_2$.

The periphery of the measuring roller 20 and the periphery of the pressure roller 21 consists in each case of two conical peripheral portions 29, 30 and 31, 32 respectively which are inclined relatively to one another. These peripheral portions have an outline which extends upwards from the edge of the roller towards the middle of the roller. A weft thread $S_1$ and $S_2$ respectively abuts tangentially on each of the peripheral portions 29, 30 of the measuring roller 20.

The pressure roller 21 can be tilted by the operating lever 27 so that one of its conical peripheral portions 31 or 32 selectively can be pressed against the corresponding peripheral portion 29 or 30 as appropriate of the measuring roller 20, and accordingly the other of its conical peripheral portions is lifted away from its associated peripheral portion on the measuring roller 20. As a result, in dependence on the pivoted position of the lever 25, the weft thread situated between the pressed-together peripheral portions of the two rollers is the one which is conveyed in each case, and the weft thread situated between the peripheral portions lifted away from one another remains stationary.

The measuring roller 20 and the pressure roller 21 always abut on one another at their highest surface line, i.e., at the surface line with the largest circumference. Since the measuring roller 20 is constantly driven and the pressure roller 21 abuts constantly at its highest surface line against the measuring roller 20, the pressure roller 21 is also in continual rotation. The angle between the two pivoted positions of the lever 25 which is shown with full lines and broken lines in FIG. 3 amounts to about 6°.

In the position of lever 25 and pressure roller 21 which is shown in FIG. 2 and in FIG. 3 (full-line position of lever 25 and pressure roller 21) the peripheral portion 31 of the pressure roller 21 is pressed against the peripheral portion 28 of the measuring roller 20 and the peripheral portion 32 of the pressure roller 21 is lifted away from the peripheral portion 30 of the measuring roller 21. Accordingly the weft thread $S_1$ is conveyed and the weft thread $S_2$ remains at rest.

Figure 4:
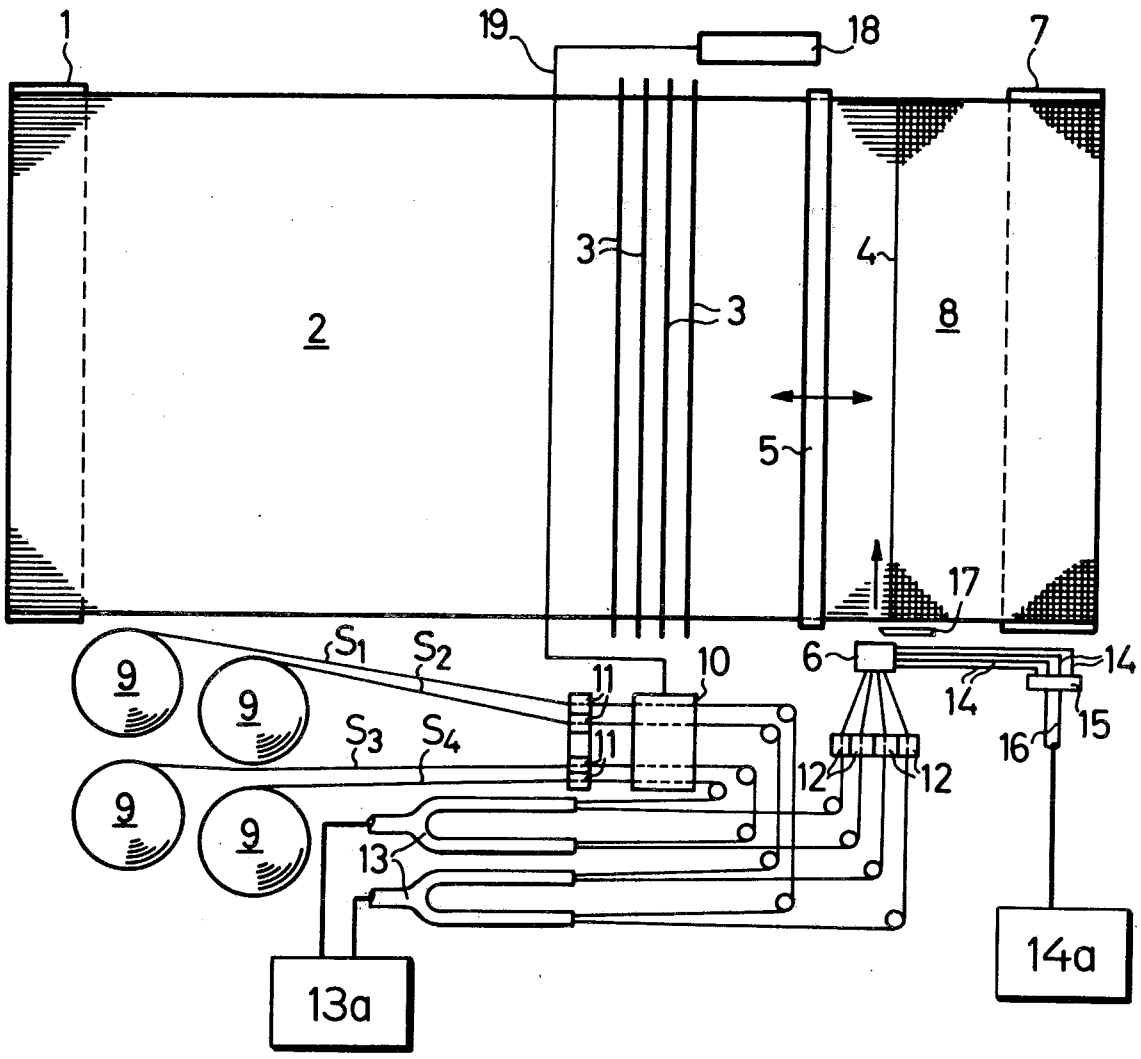
FIG. 4 is a diagrammatic plan view showing a nozzle-type weaving machine for four-color operation.

Another embodiment is shown in FIG. 4 in which the nozzle-type weaving machine is for four-color operation and differs from that shown in FIG. 1 in that there are provided four weft thread bobbins 9, from each of which a weft thread $S_1$, $S_2$, $S_3$, $S_4$ is drawn off, that there are in each case four thread brakes 11 and 12, and two storage devices 13, and that the insertion device 6 is constituted by a quadruple nozzle. A quadruple nozzle of this kind is described in Swiss Pat. No. 571,797 and in copending U.S. patent application Ser. No. 758,763.

Figure 5:
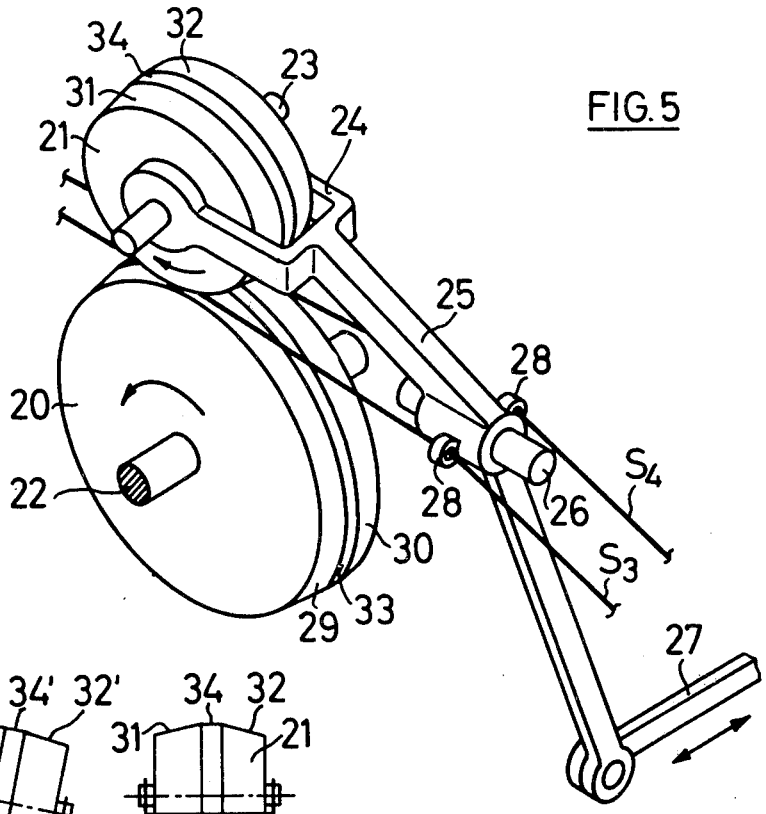
FIG. 5 is a perspective view showing a pair of conveying rollers of the weft thread conveying apparatus of the weaving machine shown in FIG. 4.
Figure 7:
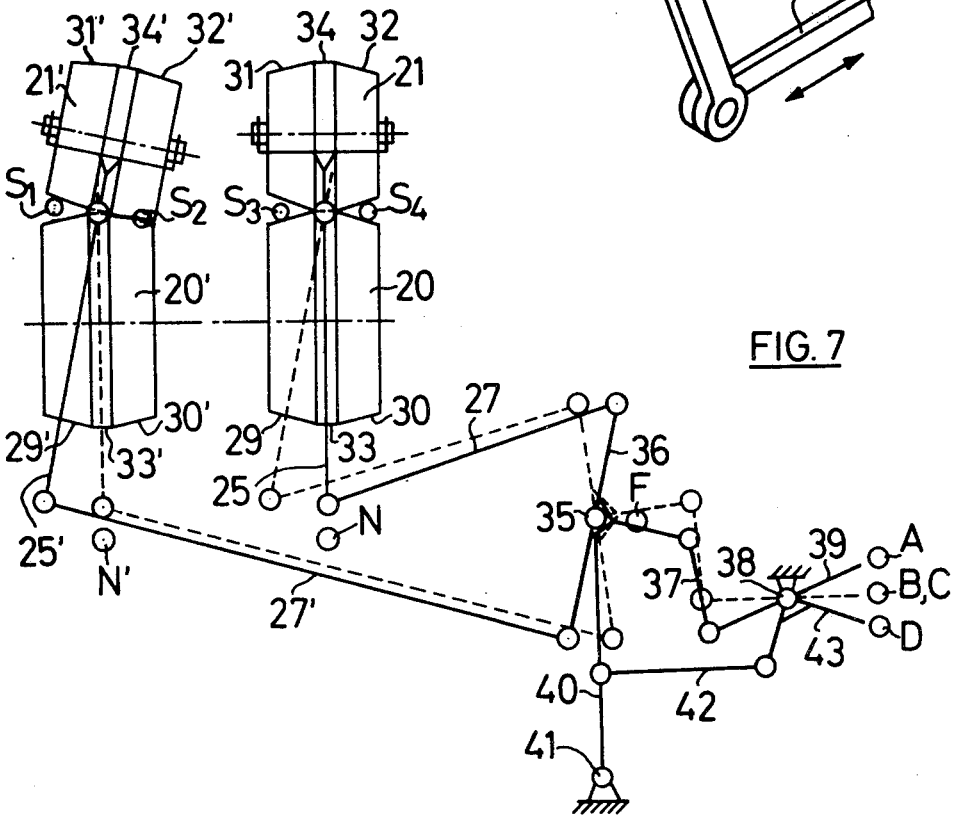
FIGS. 6 and 7 are diagrammatic views each showing two pairs of conveying rollers and their control mechanism.
Figure 6:
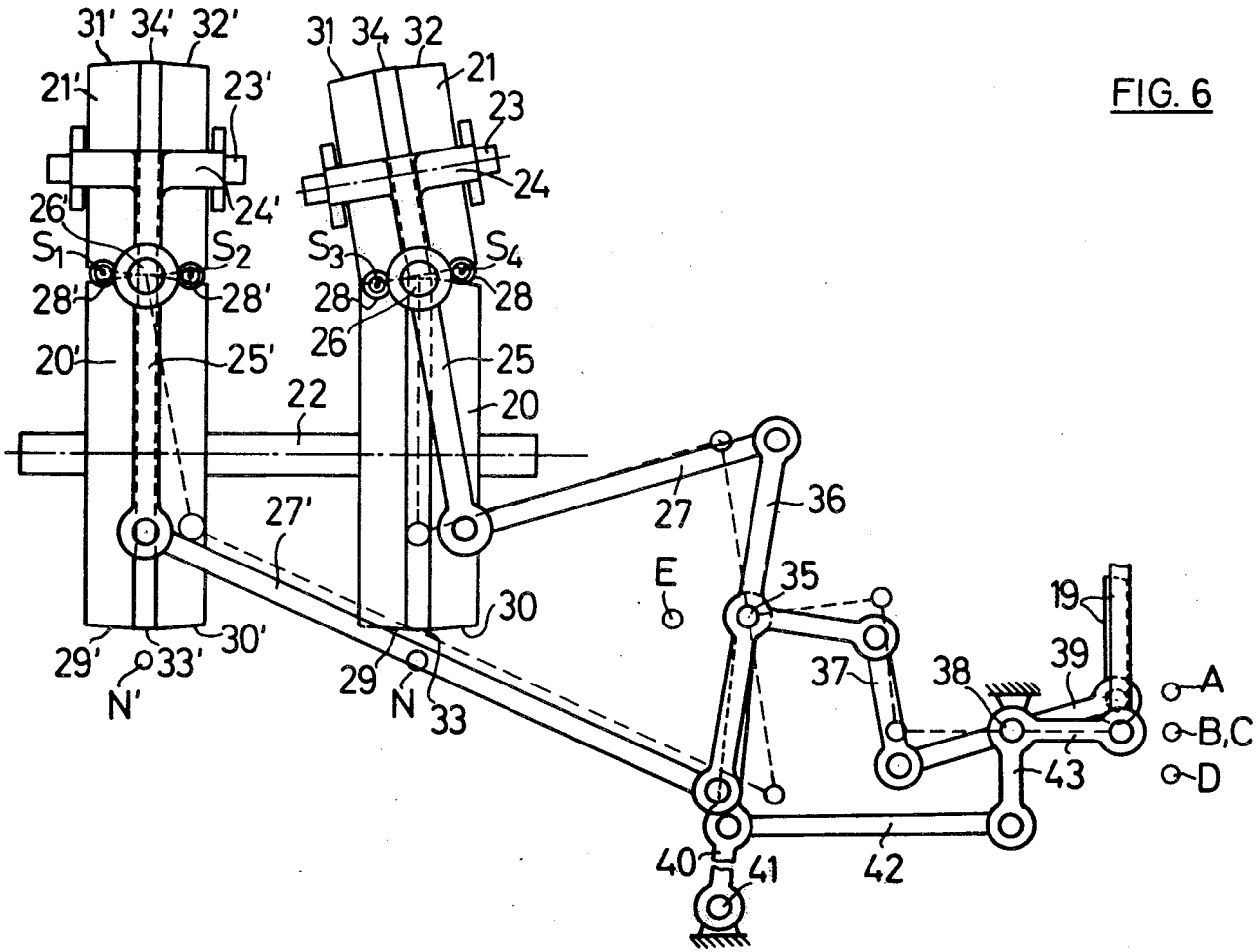

In FIGS. 5 through 7 the conveying apparatus 10 shown in FIG. 4 consists substantially of two pairs of conveying rollers comprising a measuring roller 20 or 20' and a pressure roller 21 or 21'. The measuring rollers 20 and 20' are mounted on a common driving shaft 22 and during operation rotate constantly in the direction indicated by an arrow. Each pressure roller 21, 21' is mounted by way of a shaft 23, 23' to be freely rotatable in the fork-shaped end 24, 24' of a two-arm lever 25, 25'. Each lever 25, 25' is mounted substantially at its central portion on a stationary pivot pin 26, 26'. The other end of each lever 25, 25' is connected pivotably to an operating lever 27, 27' which can be controlled by the program setter means 18 by way of a connection 19 and a control mechanism. Two pairs of guide eyelets 28 and 28' in each case for the weft threads $S_1$, $S_2$, $S_3$ and $S_4$ are arranged on the central portion of the levers 25, 25' mounted on the pivot pin 26, 26'.

The periphery of the measuring rollers 20, 20' and of the pressure rollers 21, 21' consists in each case of two first and second conical peripheral portions which are inclined relatively to one another, 29, 30 and 31, 32 on the one hand and 29', 30' and 31', 32' on the other hand, and of a third peripheral portion 33, 34 on the one hand and 33', 34' on the other hand which is arranged between the conical peripheral portions and is in the form of a straight circular cylinder. The first and second peripheral portions comprise an upwardly extending outline from the edge of the roller to the third peripheral portion. A weft thread $S_1$, $S_2$, $S_3$, $S_4$ abuts tangentially on each of the first and second peripheral portions 29, 30 and 29', 30' of the measuring roller 20 and 20' respectively.

The pressure rollers 21, 21' can be swung or tilted by the operating lever 27 or 27' respectively in such a manner that selectively one of their peripheral portions 31, 31', 32, 32' or 34, 34' is pressed against the corresponding peripheral portion 29, 29', 30, 30' or 33, 33' respectively of the measuring rollers 20, 20', and the other of their peripheral portions are correspondingly lifted away from their associated peripheral portion on the measuring roller 20, 20'. In this way, in accordance with the tilted position of the lever 25, 25', in each case the weft thread situated between the pressed-together conical peripheral portions of two rollers is the one which is conveyed, and the weft threads which are situated between the conical peripheral portions which are lifted away from one another remain stationary, and at each pair of conveying rollers which does not have a weft thread to convey, in FIG. 6 this is the left-hand pair of conveying rollers 20, 21, measuring roller 20 and pressure roller 21 are pressed together at their third peripheral portion 33, 34 and as a result run idly and do not convey a weft thread.

The measuring rollers 20, 20' and the pressure rollers 21, 21' abut constantly on one another at one of their peripheral portions. Since the measuring rollers 20, 20' are continually driven, the pressure rollers 21, 21' are also constantly in rotation. The angle between the two extreme positions of the levers 25, 25' amounts to about 6°.

In the position of the levers 25, 25' and pressure rollers 21, 21' shown in FIG. 6, the peripheral portion 34' of the pressure roller 21' is pressed against the peripheral portion 33' of the measuring roller 20' and the peripheral portion 31 of the pressure roller 21 is pressed against the peripheral portion 29 of the measuring roller 20. Correspondingly the weft thread $S_3$ is conveyed and the weft threads $S_1$, $S_2$ and $S_4$ remain stationary.

The operating levers 27, 27' are each pivotably connected on an arm of a common three-arm lever 36 which is pivotable about a bearing point 35 adjustable into two positions E and F. The third arm of the lever 36 is connected pivotably by way of an intermediate rod 37 to one end of a two-arm control lever 39, a first control lever pivotable about a first fixed bearing 38. The other end of the first control lever 39 is connected to the connection 19 leading to the program setter means 18, see FIG. 4.

The bearing point 35 of the three-arm lever 36 is situated at one end of a pivotable rod 40 whose other end is secured pivotably on a second stationary bearing 41. The pivotable rod 40 is connected pivotably by means of an intermediate rod 42 to one end of a right-angled second control lever 43. The second control lever 43 is pivotably mounted at its apex at the stationary bearing point 38 and is connected at its other end to the connection 19 leading to the program setter means 18.

The operation of the control mechanism just described for the operating levers 27, 27' will now be described in conjunction with FIGS. 6 and 7: The first and second control levers 39 and 43 are each pivotable between two pivoted positions A and B on the one hand and C and D on the other hand. When the second control lever 43, whereby the bearing point 35 of the three-arm lever 36 is secured, is in its pivoted position C, the bearing point 35 is pivoted towards the right, that is to say into the pivoted position F. The pivoted position E of the bearing point 35 corresponds to the pivoted position D of the second control lever 43.

In each pivoted position of one control lever, the other control lever can take up two different pivoted positions, and vice versa.

When for example the second control lever 43 is in the pivoted position C (FIG. 6), the first control lever 39 can take up the two pivoted positions A or B. In pivoted position A (FIG. 6, lever positions shown in full lines), the pressure roller 21' of the left-hand pair of conveying rollers 20', 21' is in its neutral conveying position N' in which none of the weft threads $S_1$ or $S_2$ is conveyed. In the case of the right-hand pair of conveying rollers 20, 21, the pressure roller 21 is tilted over towards the left so that the weft thread $S_3$ is conveyed and the weft thread $S_4$ is not conveyed.

If, with the pivoted position C of the second control lever 43 unaltered, the first control lever 39 takes up the pivoted position B (FIG. 6, lever positions shown in broken lines) at the left-hand pair of conveying rollers 20', 21', the pressure roller 21' is tilted over towards the left and the weft thread $S_1$ is conveyed and the weft thread $S_2$ is not conveyed. At the right-hand pair of conveying rollers 20, 21 the pressure roller 21 is tilted over into its neutral conveying position N so that none of the weft threads $S_3$ or $S_4$ is conveyed.

If the second control lever 43 is in the pivoted position D (FIG. 7), the first control lever 39 can also take up the two pivoted positions A or B: In the pivoted position A (FIG. 7, lever positions shown in full lines) at the left-hand pair of conveying rollers 20', 21' the pressure roller 21' is tilted over towards the right and the weft thread $S_2$ is conveyed, and the weft thread $S_1$ is not conveyed.

In the case of the right-hand pair of conveying rollers 20, 21 the pressure roller 21 is tilted over into its neutral conveying position N, so that neither of the weft threads $S_3$ or $S_4$ is conveyed.

If with the pivoted position D of the second control lever 43 unaltered, the first control lever 39 takes up the pivoted position B (FIG. 7, lever positions shown in broken lines) at the left-hand pair of conveying rollers 20', 21' the pressure roller 21' is tilted into its neutral conveying position N', so that neither of the weft threads $S_1$ or $S_2$ is conveyed. In the case of the right-hand pair of conveying rollers 20, 21 the pressure roller 21 is tilted over towards the right and the weft thread $S_4$ is conveyed and the weft thread $S_3$ is not conveyed.

It will be appreciated that each of the two operating levers 27, 27' could be connected to a separate control mechanism. These control mechanisms, however, have to ensure not only that in that particular pair of conveying rollers which does not have a weft thread to convey, the pressure roller 21 or 21' is in its neutral conveying position N or N' respectively, but also that when one pair of conveying rollers is conveying the other pair reliably must not convey. To meet this second condition, a coupling in the manner of a locking device must be provided between the two control mechanisms. It has been found that the control mechanism shown in FIGS. 6 and 7 meets both conditions in the best possible way and with simple means.

It will be appreciated further that the weft thread conveying apparatus according to the invention is of course not limited to being used on four-color nozzle weaving machines, but, by arranging a plurality of pairs of conveying rollers in a series can be expanded to deal with any number of colors without altering anything in the essential features of the subject of the invention.

It is submitted that the corresponding arrangement of the control mechanism for the operating levers of the pressure rollers is within the understanding and ability of the average person skilled in the art and does not have to be explained in detail here.

What is claimed is:

1. Weft thread conveying apparatus for shuttleless weaving machines having two weft thread insertion nozzles for passing weft threads between a pair of conveying rollers adapted to be continuously driven, characterized in that each of said rollers has a periphery with two conical peripheral portions which are inclined relatively to one another and extend upwards from the edge of the roller towards the middle of the roller, one of the said pair of conveying rollers mounted to be capable of tilting for selective engaging of one of its peripheral portions against its corresponding peripheral portion of the other conveying roller, means for selectively tilting one of said rollers to press one of its peripheral portions towards the corresponding peripheral portion of the other conveying roller to engage a weft thread therebetween, and said tiltably mounted conveying roller mounted to be freely rotatable on one end of a two-arm rocking lever.

2. The weft thread conveying apparatus according to claim 1 in which the weft threads which are to be conveyed are guided through the space between corresponding peripheral portions of the two conveying rollers.

3. The weft thread conveying apparatus according to claim 2 in which one of the pair of conveying rollers is arranged in a stationary manner and both conveying rollers are continuously in contact with one another at their surface line with the largest diameter in each case.

4. Weft thread conveying apparatus for shuttleless weaving machines having two weft thread insertion nozzles for passing weft threads between a pair of conveying rollers adapted to be continuously driven, characterized in that each of said rollers has a periphery with two conical peripheral portions which are inclined relatively to one another and extend upwards from the edge of the roller towards the middle of the roller, one of said pair of conveying rollers mounted to be capable of tilting for selective engaging of one of its peripheral portions against its corresponding peripheral portion of the other conveying roller to engage a weft thread therebetween, said tiltably mounted conveying roller mounted to be freely rotatable on one end of a two-arm rocking lever, and the said rocking lever arranged to be capable of pivoting in the region of the central portion about a shaft which is arranged on the common tangential plane of the two conveying rollers and is directed parallel to the plane of the other conveying roller.

5. The weft thread conveying apparatus according to claim 4 in which the other end of the rocking lever is connected to a programme setter means.

6. The weft thread conveying apparatus according to claim 5 in which the rocking lever is provided in the region of its central portion with two thread guide eyelets for guiding the weft threads and these threads guide eyelets are situated at the two sides of said shaft.

7. The weft thread conveying apparatus according to claim 4 in which a plurality of pairs of conveying rollers are provided, and there are associated with each pair of conveying rollers two insertion nozzles, and each of the rollers has a third peripheral portion in the form of a straight circular cylinder, which third peripheral portion is situated between the two conical peripheral portions, and when the two rollers of a pair of rollers abut on one another at their third peripheral portion, both the associated weft threads between the pairs of rollers are not conveyed.

8. The weft thread conveying apparatus according to claim 7 in which the tiltably mounted conveying rollers are each mounted to be freely rotatable at one end of a two-arm rocking lever on the other end of which an operating lever is pivotably connected in each case.

9. The weft thread conveying apparatus according to claim 8 in which the operating levers are connected to a control mechanism which can be controlled by a program setter means and by which the tiltably mounted conveying rollers are so controlled that on the one hand the rollers of that pair of conveying rollers which does not have a weft thread to convey abut on one another with their third peripheral portion and take up their neutral conveying position N, N', and on the other hand one pair of conveying rollers always conveys a weft thread and the other takes up its neutral conveying position.

10. The weft thread conveying apparatus according to claim 9 in which the operating levers are pivotably connected each to an arm of a common three-arm lever capable of pivoting about a bearing point adjustable into two positions E, F, the third arm of the said lever being connected pivotably by way of an intermediate rod to one end of a two-arm first control lever which is pivotable about a first stationary bearing point; the bearing point of the three-arm lever is supported by one end of a pivotable rod which is secured on a second stationary bearing point and which is connected pivotably by way of an intermediate rod to one end of an angled second control lever mounted to be pivotable at its apex on the first stationary bearing point of the first control lever; and the first and second control levers are connected to the program setter means.

* * * * *